US009297222B1

(12) United States Patent
Baryam

(10) Patent No.: US 9,297,222 B1
(45) **Date of Patent: *Mar. 29, 2016**

(54) METHOD FOR MANIPULATING A TUBULAR

(71) Applicant: SCORPION OIL TOOLS, INC., Houston, TX (US)

(72) Inventor: Jacob Baryam, Houston, TX (US)

(73) Assignee: SCORPION OIL TOOLS, INC., Houston, TX (US)

( * ) Notice: Subject to any disclaimer, the term of this patent is extended or adjusted under 35 U.S.C. 154(b) by 256 days.

This patent is subject to a terminal disclaimer.

(21) Appl. No.: 14/084,573

(22) Filed: Nov. 19, 2013

Related U.S. Application Data

(63) Continuation-in-part of application No. 13/302,554, filed on Nov. 22, 2011, now Pat. No. 8,601,911.

(51) Int. Cl.
*E21B 19/16* (2006.01)
*B25B 13/50* (2006.01)

(52) U.S. Cl.
CPC ..... *E21B 19/16* (2013.01)

(58) Field of Classification Search
CPC ..... E21B 19/16; E21B 19/163; B25B 13/52
See application file for complete search history.

(56) References Cited

U.S. PATENT DOCUMENTS 3,288,001 A * 11/1966 Laird, Jr. ..... B25B 13/52 81/68
3,880,024 A * 4/1975 Asada ..... B25B 13/52 81/57.34
4,885,963 A * 12/1989 Nishikawa ..... B25B 13/14 173/164
5,653,297 A * 8/1997 Whisenhunt ..... E21B 19/163 173/164
6,065,372 A * 5/2000 Rauch ..... E21B 19/168 81/57.15
7,076,852 B2 * 7/2006 Penman ..... B23P 19/061 285/38
7,114,234 B2 * 10/2006 Penman ..... B23P 19/061 29/235
7,997,166 B2 * 8/2011 Lauzon ..... E21B 19/161 81/57.34
7,997,167 B2 * 8/2011 Kruse ..... E21B 19/161 81/57.19
8,601,911 B1 * 12/2013 Baryam ..... B25B 13/50 81/57.15
9,097,071 B1 * 8/2015 Baryam ..... E21B 19/163 81/57.33

* cited by examiner

*Primary Examiner* — David B Thomas
(74) *Attorney, Agent, or Firm* — Buskop Law Group, PC; Wendy Buskop

(57) ABSTRACT

A method for making-up or breaking-out a pair of tubulars using a tong assembly of a drilling rig. The method uses a pair of chain assemblies connected to hydraulic chain cylinders, a first jaw connected to a first arm for supporting a first tubular, a second jaw connected to a break-out body between the break-out body and the second chain cylinder, and a make out break-out cylinder to push the chain cylinders in a make-up rotation or a break-out rotation allowing the method to provide changes of direction without changing tong assembly configuration or position.

18 Claims, 9 Drawing Sheets

METHOD FOR MANIPULATING A TUBULAR

CROSS REFERENCE TO RELATED APPLICATIONS

The present application is a Continuation in Part of co-pending U.S. patent application Ser. No. 13/302,554 filed on Nov. 22, 2011, entitled "TONG ASSEMBLY FOR MANIPULATING A TUBULAR." This reference is hereby incorporated in its entirety.

FIELD

The present embodiments generally relate to method for using a tong arm for use with a tong assembly to make-up or break-out tubulars for drilling a hydrocarbon well.

BACKGROUND

A need exists for a method to make-up or break-out tubulars on a drill string or for use with a drilling rig that also uses a tong assembly, wherein the operators have limited training or expertise.

A further need exists for method to make-up or break-out tubulars with a tong assembly that minimizes minimal risk and minimizes human interaction that enables a tong assembly to move from a make-up direction of rotation to a break-out direction of rotation without having to change the tong assembly set up, simply by moving a cylinder rod in a different direction.

The present embodiments meet these needs.

BRIEF DESCRIPTION OF THE DRAWINGS

The detailed description will be better understood in conjunction with the accompanying drawings as follows.

Figure 1:
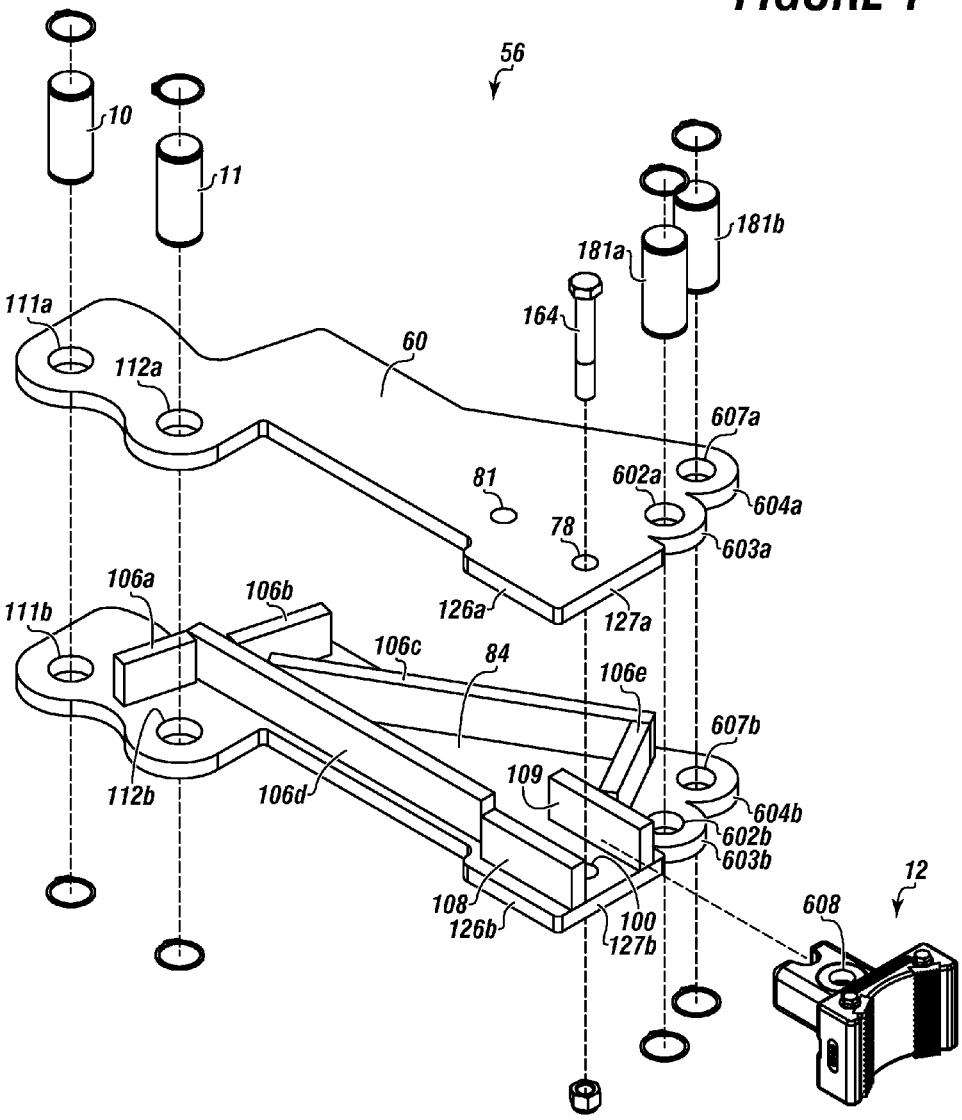
FIG. 1 depicts an exploded view of an arm frame usable with one or more embodiments of the method.

The present embodiments are detailed below with reference to the listed Figures.

DETAILED DESCRIPTION OF THE EMBODIMENTS

Before explaining the present method in detail, it is to be understood that the method is not limited to the particular embodiments and that it is practiced or carried out in various ways.

The present embodiments generally relate to a method for making-up or breaking-out of tubulars for drilling a wellbore using a tong assembly with a break-out/make-up arm, which is spaced apart from a backup arm. The break-out/make-up arm, the backup arm or combinations thereof, engage tubulars, such as drill pipe.

The method for making-up or breaking-out of tubulars for drilling a wellbore using a tong assembly in embodiments, can use one level with one stock for instantaneous make-up which can then be immediately changed to break-out procedure.

By avoiding the need to change equipment position, and simply use one lever, greater safety occurs at a drill site, reducing broken bones and severed body parts with the tong assembly.

The method for making-up or breaking-out of tubulars for drilling a wellbore using a tong assembly can prevent work slows by replacing manual tongs, leading to overall employment growth.

The method can prevent layoffs or employee replacement by preventing injuries that can require hospitalization. The method enables instantaneous and immediate transition of rotation from make-up to break-out.

The method can use a tong assembly with a design which internally dissipates energy, aiding in the prevention of violent energy releases that can lead to oil spills at a drill site.

The method teaches a make-up and break-out technique that is extremely portable and requires little extra equipment, which can allow water well drilling to be done safely by low skill individuals in remote towns and villages.

The present method does not require a machine set up change when changing from a break-out operational mode to a make-up operational mode or vice versa.

The method allows effortless and immediate change from making-up to breaking-out of a pipe instantly, from a tubular make-up orientation (a forward rotating direction) to a tubular break-out orientation (a reverse rotating direction from the make-up rotational direction).

Typical tong assemblies can require an hour or more to set up the machine for making up or breaking out of tubulars. This method enables a change from make-up to break-out of tubulars for drill pipe in a drill string in less than 5 minutes.

The present embodiments relate to a method to break-out/make-up a pair of tubulars using a tong assembly for use in drilling a wellbore usable with an apparatus.

The method can include engaging a first tubular with a chain assembly connected to a rigid body.

The method can include pulling the chain assembly tight around the first tubular using a chain cylinder connected to the rigid body.

The method can include connecting the first tubular with a jaw secured to the rigid body.

The method can include connecting tong dies on the chain assembly to the first tubular.

In embodiments, the rigid body can be a fixed back up for the breaking-out and making-up of the first tubular with a second tubular.

The method can include engaging a second tubular with a second chain assembly connected to a break-out frame.

The method can include pulling the second chain assembly tight around the second tubular using the second chain cylinder to connect the second tubular with a second jaw secured to the break-out frame and connect tong dies on the second chain assembly with the second tubular.

The method can include operating a break-out cylinder connected to the rigid body to perform a make-up operation by rotating the chain assembly in a first direction rotating the first tubular while holding the second tubular with the second chain assembly without movement of the second chain assembly creating a backup assembly that works in embodiments as a vise.

In the method, the break-out cylinder with the rigid body enables the two tubulars to connect together and form a tubing joint.

In the method, a break-out operation is performed by rotating the chain assembly in a second direction opposite the first direction.

The chain assembly can rotate the first tubular while holding the second tubular with second chain assembly without movement of the second chain assembly creating a back-up assembly, enabling the two tubulars to separate and be broken-out.

In embodiments, the method can include using tubulars with an outer diameter from 1 inch to 36 inches.

In embodiments, the method can include pulling either of the chain assemblies tight around the tubular using pressures from 100 psi to 4000 psi.

In embodiments, the method can include rotating the chain assembly from 0 degrees to 90 degrees.

The method can include rotating the chain assembly from 0 degrees to 45 degrees for make-up of the tubulars and 0 degrees to 45 degrees for break-out of the tubulars.

The method can include using a chain assembly connected to the arm frame using a pair of chain assembly pins, one chain assembly pin connecting each end of the chain assembly, each chain assembly pin penetrating aligned chain connection holes in the top and bottom plate.

The method can include using a plurality of parallel tong die grooves with a tong die in each tong die groove on the face of each jaw and each chain assembly.

In embodiments, the method can include using a tapered jaw tail opposite the jaw head while maintaining at least 50 percent continuous contact between the outer surface and the load supporting walls between the top and bottom plates for load transfer from the tail to the arm frame or the rigid body.

In embodiments, the method can include using each chain assembly to enable flexibility to connect around variable outer diameters of tubulars.

In embodiments, each chain assembly can have a plurality of chain links connected in series and a locking link connecting one of the chain links to a chain cylinder.

In embodiments, the chain links can connect in series and connect around a tubular outer diameter.

In embodiments, each chain link can have a chain link face, a chain link back, and at least one tong die groove formed in each chain link face having groove edges.

In embodiments, one of the handles of a plurality of handles can be attached to a chain link, or the locking link, providing gripping safety when installing the chain assembly around the tubular or removing the chain assembly from the tubular.

The method can include connecting each of the chain links in series to hinge pins through connection holes into the arm for quick connect and quick disconnect in the case of an emergency.

Turning now to the Figures, FIG. 1 shows an arm frame 56 for a break-out/make-up arm for a tong assembly.

The arm frame 56 can have a top plate 60, which can have a top fastening hole 78 for receiving a jaw retaining pin 164.

The top plate 60 can have a top reducer hole 81 for retaining added parts to the arm frame, such as accessories like a reducer, to accommodate a smaller outer diameter pipe.

Spaced apart from the top reducer hole 81 can be a first top chain connection hole 602*a* and a second top chain connection hole 607*a*.

A break-out/make-up cylinder connection hole 111*a* can engage a first cylinder connecting pin 10. The first cylinder connecting pin 10 can hold a break-out/make-up cylinder.

Usable break-out/make-up cylinders can be hydraulic and self-contained units, in embodiments.

In embodiments, the break-out/make-up cylinder can perform two different activities. The break-out/make-up cylinder can both make-up and break-out drill pipe using only one configuration to do both activities.

In embodiments, once positioned, the dual purpose break-out/make-up cylinder can handle forward and reverse stroking.

In embodiments, when stroking out, the break-out/make-up cylinder can perform a break-out/make-up stroke for breaking out a first tubular to any kind of connection or for breaking-out a first tubular to a second tubular.

In embodiments, when stroking out, the break-out/make-up cylinder can apply up to 4000 psi, or pressure as needed, to break-out two tubulars or a tubular with a connection.

In embodiments, a dual purpose break-out/make-up cylinder can be used with a rod that extends and retracts hydraulically.

In embodiments, for break-out, the dual purpose break-out/make-up cylinder can use as much psi as needed in order to break a pipe joint.

In embodiments, in make-up operational mode, the dual purpose break-out/make-up cylinder can supply a controlled pressure in order to limit excessive torque applied to drill pipe as needed or as specified by the manufacturer of a pipe joint.

By controlling pressure, the amount of torque that needs to be applied to the drill pipe is controlled. The apparatus prevents over torqueing of the drill pipe and prevents shearing of drill pipe threads.

A chain cylinder connection hole 112*a* can engage a second cylinder connecting pin 11 for holding a chain cylinder.

The break-out/make-up cylinder connection hole 111*a* and the chain cylinder connection hole 112*a* can range in diameter from 0.50 inches to 3 inches.

In embodiments, the top plate 60 can have a first concave edge 603*a* configured to accommodate a chain link. The first concave edge 603*a* can match a chain link radius of a chain assembly.

The top plate can have a second concave edge 604*a* configured to accommodate larger radius or larger outer diameters of tools than the maximum capacity of the first concave edge 603*a* of the top plate. The top plate can have a rod rest 126*a*.

In embodiments, the top plate can have a jaw resting edge 127*a*. The jaw resting edge 127*a* can be configured to support a jaw 12.

The top plate can receive, through the first top chain connection hole 602*a*, a first chain connection pin 181*a* for connecting between the top plate to the chain assembly.

The top plate can receive, through the second top chain connection hole 607*a*, a second chain connection pin 181*b* for connecting between the top plate and the chain assembly.

A bottom plate 84 can have matching aligned holes with the top plate 60. The bottom plate can be mounted to align with the top plate.

Mounted between the top and bottom plates can be side support plates 106*a*, 106*b*, 106*c*, 106*d* and 106*e*. Side support plate 106*e* can support the first and second chain connection pins 181*a* and 181*b*, enabling a load transfer from the chain connection pins.

The plurality of side support plates can connect the top and bottom plates. In an embodiment, the side support plates can be welded to the top and bottom plates.

In embodiments, the side support plates can be from 1 inch to 3 inches in height. The side support plates can be from 0.5 inches to 1 inch in thickness. The side support plates can be formed from steel.

In embodiments, the bottom plate 84 can have a bottom fastening hole 100, which aligns with the top fastening hole 78.

In embodiments, the bottom plate can also have a bottom reducer which aligns with the top reducer hole.

In embodiments, the bottom plate 84 can have a first bottom chain connection hole 602*b* and a second bottom chain connection hole 607*b*. The first and second bottom chain connection holes can align with the first and second top chain connection holes of the top plate.

The bottom plate can have a jaw resting edge 127*b*. The jaw resting edge 127*b* and the jaw resting edge 127*a* can both be configured to support the jaw 12.

The bottom plate can have a pair of load support walls 108 and 109.

In embodiments, the load support walls can be mounted to the bottom plate in parallel with each other.

In embodiments, the load support walls can be mounted in a tapered configuration that tapers from a large end at the jaw resting edge to a more narrow location interior of the arm frame.

In embodiments, the load support walls and the spacing bars can all be the same height.

The pair of load support walls can create a pocket between the top and bottom plates. The pocket can have the top and bottom fastening holes and the jaw retaining pin extend through it. The jaw retaining pin 164 can hold the tail of the jaw through a tail hole 608 between the top and bottom plates.

The bottom plate can include a break-out/make-up cylinder connection hole 111*b*, a chain cylinder connection hole 112*b*, and rod rest 126*b*.

The first bottom chain connection hole 602*b* can be formed within a first concave edge 603*b*.

The second bottom chain connection hole 607B can be formed within a second concave edge 604*b*.

Figure 2A:
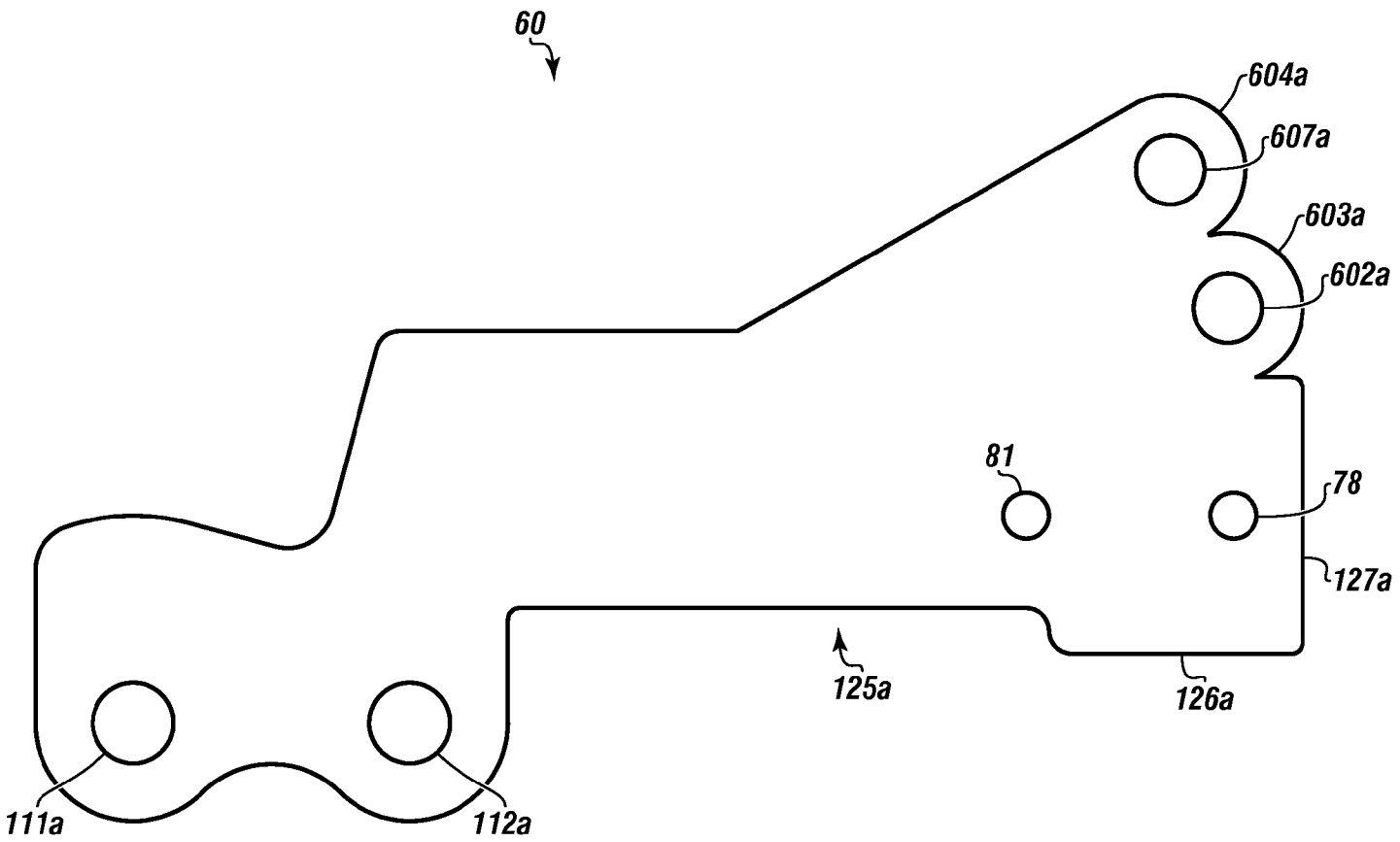
FIG. 2A depicts a top view of a top plate of the arm frame usable with one or more embodiments of the method.

FIG. 2A shows a top view of the top plate usable with one or more embodiments of the method.

The top plate 60 is shown with the top fastening hole 78, the break-out/make-up cylinder connection hole 111*a*, the chain cylinder connection hole 112*a*, a top reducer hole 81, and a notch 125*a* adjacent the top reducer hole on the same side as the chain cylinder connection hole.

The notch 125*a* can be configured to accommodate a body of the chain cylinder.

In currently available systems, when a chain cylinder body rests in contact with the arm frame, the cylinder rod of the chain cylinder can be pulled toward the arm frame improperly, creating a side load that will cause the rod to pull inward toward the arm frame and bend or break.

In the present embodiments, the notch 125*a* formed in the top plate and the corresponding notch in the bottom plate are configured so that the cylinder rod rests on rod rest 126*a* of the top plate and the rod rest of the bottom plate.

The notches enable the chain cylinder to be larger in size than those usable in currently available tong assemblies, providing a chain cylinder that generates a stronger gripping force.

The notches also enable the chain cylinder to operate with the chain assembly to handle smaller outer diameter tubular joints. This notch is a major benefit of this invention. The notch enables this tong assembly to be more versatile than other tong assemblies without requiring additional parts and without requiring additional time for tong assembly set up.

The notch enables the apparatus to have a chain cylinder that is safer than other tong assemblies because the configuration reduces the possibility of rod damage.

The top plate is shown with the jaw resting edge 127*a* formed on a side at a right angle to the side with the rod rest 126*a*.

The top plate is shown with the first top chain connection hole 602*a* formed within the first concave edge 603*a* and the second top chain connection hole 607*a* formed within the second concave edge 604*a*.

Figure 2B:
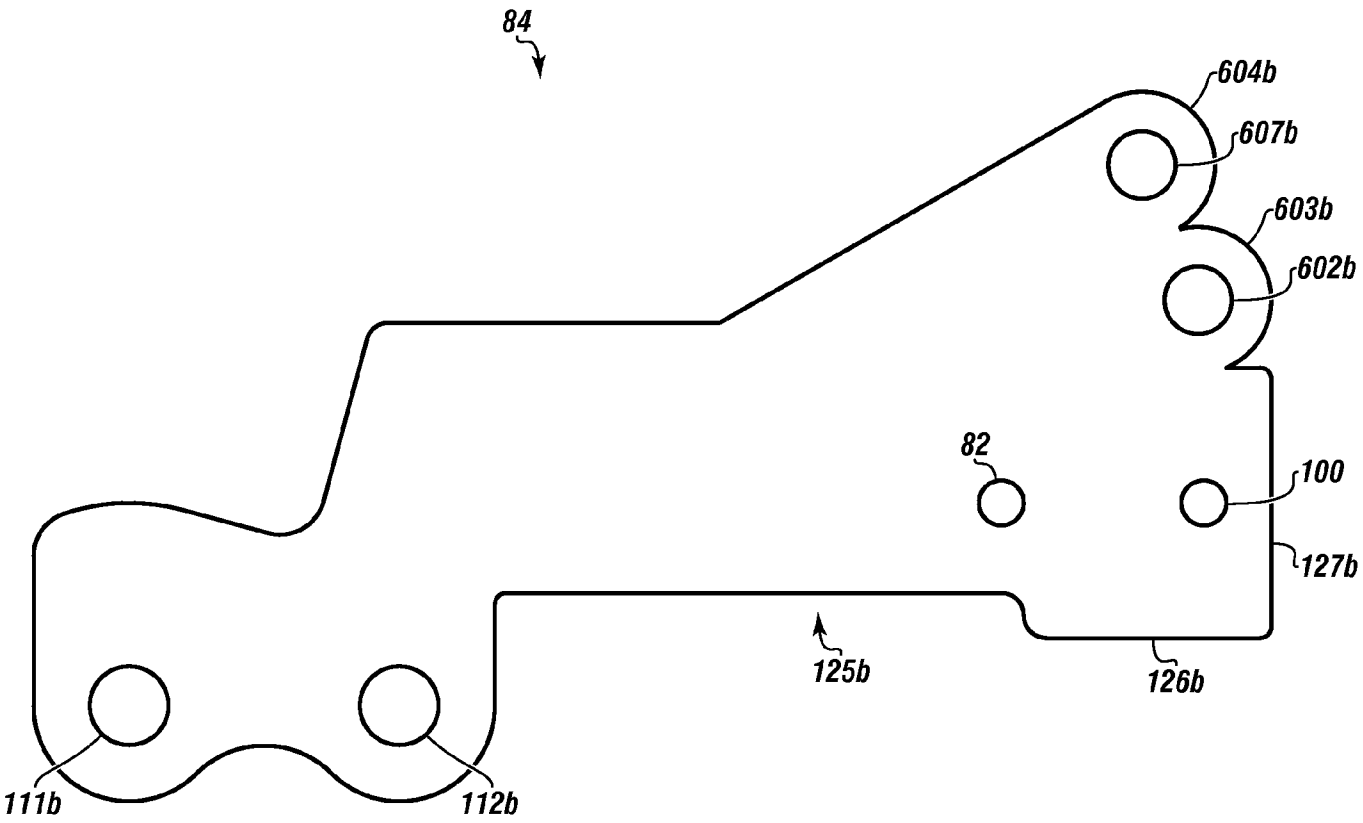
FIG. 2B depicts a bottom view of a bottom plate of the arm frame usable with one or more embodiments of the method.

FIG. 2B shows a bottom view of the bottom plate usable with one or more embodiments of the method.

The bottom plate 84 is shown with the bottom fastening hole 100, the break-out/make-up cylinder connection hole 111*b*, and the chain cylinder connection hole 112*b*.

The bottom plate can have a notch 125*b*, which can be identical to the notch in the top plate.

The bottom plate is also shown with a bottom reducer hole 82, the rod rest 126*b*, the jaw resting edge 127*b* formed on a side at a right angle to the side of the bottom plate with the rod rest, the first bottom chain connection hole 602*b* formed within the first concave edge 603*b*, and the second bottom chain connection hole 607*b* formed within the second concave edge 604*b*.

Figure 3B:
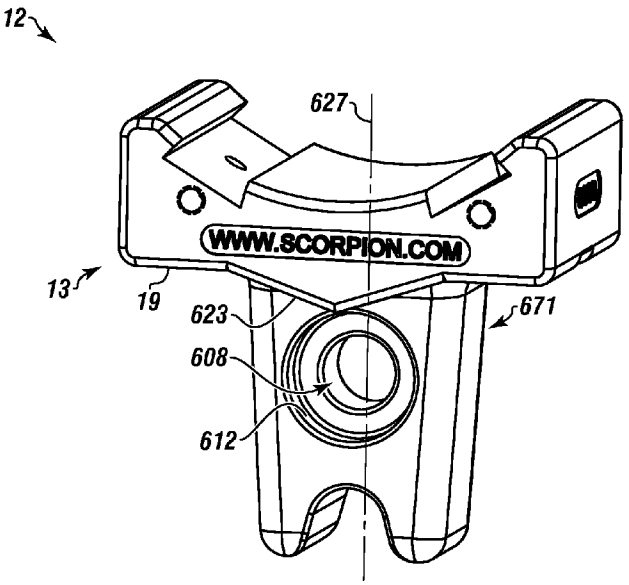
FIG. 3B depicts a perspective view of a two tong die jaw with tapered jaw tail and latching member usable with one or more embodiments of the method.
Figure 3C:
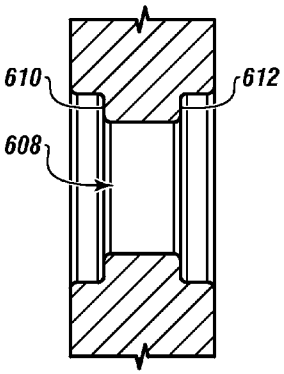
FIG. 3C shows a side view of a tail hole usable with one or more embodiments of the method.
Figure 3A:
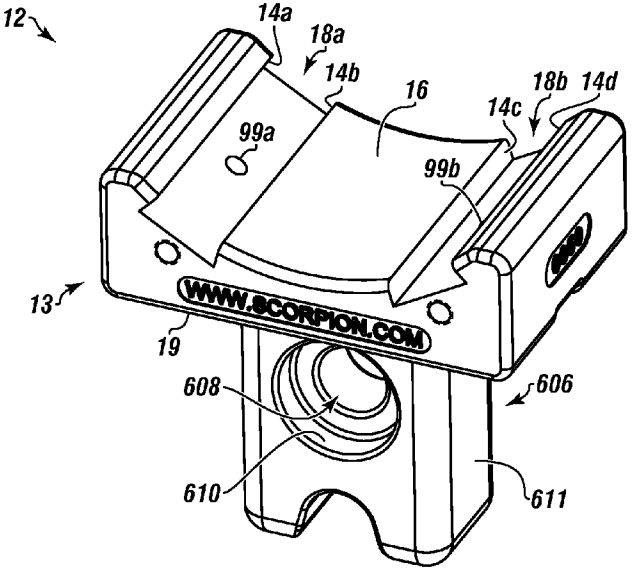
FIG. 3A depicts a perspective view of a two tong die jaw usable with the arm usable with one or more embodiments of the method.

FIG. 3A depicts a perspective view of the jaw usable with one or more embodiments of the method.

The jaw 12 can have a jaw head 13 and a jaw tail 606. The jaw head can be wider than the jaw tail.

In embodiments, the jaw head 13 can have two tong die grooves 18*a* and 18*b*.

The jaw head 13 can have a face 16 formed between the two tong die grooves.

The jaw head 13 can have a first sloped edge 14*a* and a second sloped edge 14*b* forming the first tong die groove 18*a*.

The jaw head 13 can have a third sloped edge 14*c* and a fourth sloped edge 14*d* forming the second tong die groove 18*b*.

The tong dies can be removably inserted in the tong die grooves.

The jaw head can have a load surface 19 opposite the face 16 for engaging the jaw resting edges of the arm frame.

Each tong die groove can have a holding means to assist in holding the tong die into the tong die groove. The holding means can be a detent that fits into a detent hole 99*a* in the tong die groove 18*a* and a similar detent hole 99*b* in the tong die groove 18*b*.

The jaw tail 606 can extend from the jaw head 13 opposite the face 16 for insertion between the top and bottom plates in the pocket.

The jaw tail 606 is shown with the tail hole 608 for receiving the jaw retaining pin.

The jaw retaining pin can be inserted through the top fastening hole and the bottom fastening hole simultaneously while engaging the tail hole to hold the tail into the pocket when the arm is assembled.

The jaw tail can have an outer side 611 configured for contacting simultaneously against load support walls in the pocket between the top and bottom plates.

The first damper cavity 610 can surround a first side of the tail hole 608 on a first side.

A second damper cavity can surround a second side of the tail hole. A damper can be inserted into each damper cavity.

FIG. 3B depicts a perspective view of the jaw 12 with a tapered jaw tail 671 and latching member 623 usable with the arm frame. The jaw can be a two tong die jaw.

The jaw head 13 and connected tapered jaw tail 671 have an axis 627. The ends of the tapered jaw tail that extend from the jaw head come together toward the axis 627.

The jaw head 13 and latching member 623 are shown extending away from the load surface 19 for latching the jaw tail into the pocket.

The second damper cavity 612 is shown surrounding the tail hole 608.

FIG. 3C shows a side view of the tail hole 608 with the first damper cavity 610 and the second damper cavity 612.

Figure 4:
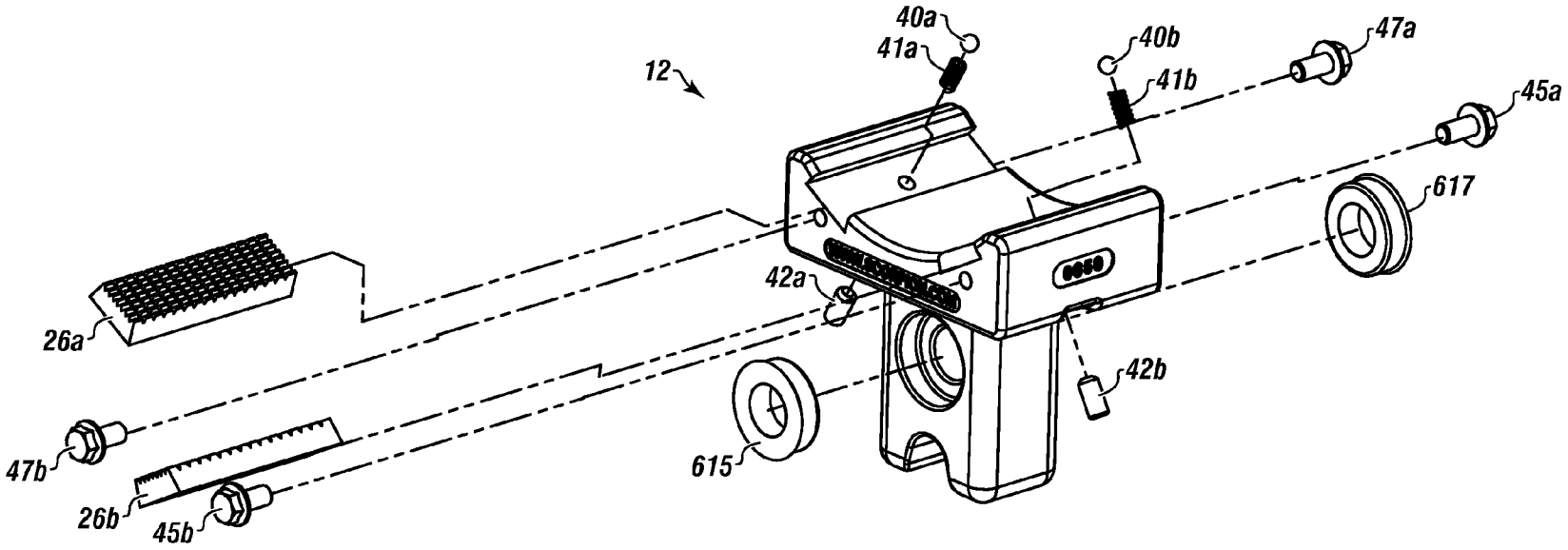
FIG. 4 depicts an exploded view of a two tong die jaw usable with one more embodiments of the method.

FIG. 4 depicts an exploded view of the jaw usable with one or more embodiments of the method.

The jaw 12 can have a plurality of tong die grooves, with each groove having a holding means.

Tong dies 26*a* and 26*b* can fit within each of the tong die grooves.

The first tong die 26*a* can be held in the tong die groove using a first holding means, shown here as a ball 40*a* and spring 41*a* held by a fastener 42*a*, forming a detent as the holding means.

The second tong die 26*b* can be held in the tong die groove using a second holding means, shown here as a ball 40*b* and spring 41*b* held by a fastener 42*b*, which can be identical to the first detent.

Each holding means can provide a holding compression to prevent the tong die from sliding out of the tong die groove.

A first rubber/elastomeric damper 615 can be disposed in the first damper cavity of the first side of the jaw tail. A second rubber/elastomeric damper 617 can be disposed in the second damper cavity on the second side of the jaw tail.

Two screws 45*a* and 45*b* can hold the second tong die 26*b* in one of the tong die grooves.

Two screws 47*a* and 47*b* can hold the first tong die 26*a* in the other tong die groove.

Figure 5A:
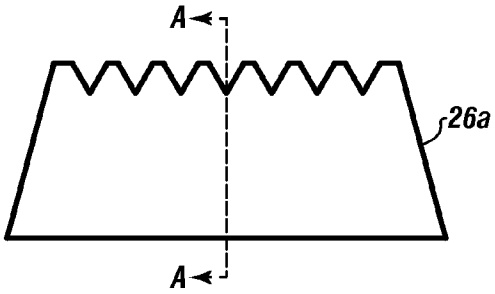
FIG. 5A depicts a side view of an exemplary tong die usable with one or more embodiments of the method.
Figure 5B:
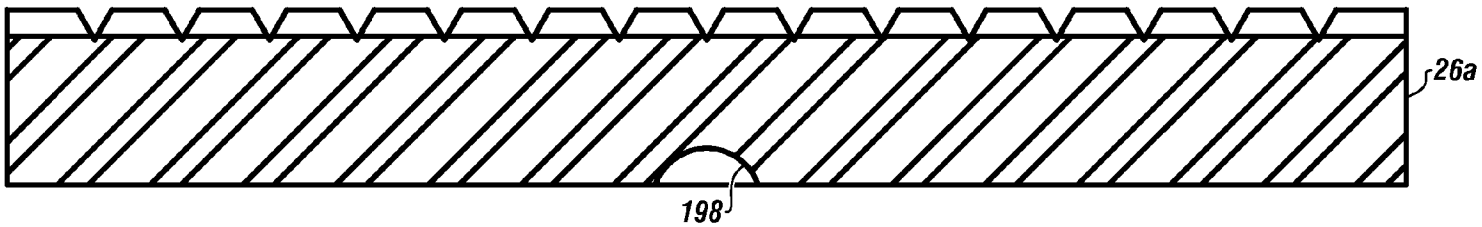
FIG. 5B depicts a cut view of the exemplary tong die of FIG. 5A.

FIG. 5A depicts a side view of the tong die with teeth usable with one or more embodiments of the method. FIG. 5B depicts a cut view of the tong die of FIG. 5A.

A depression 198 can be in the first tong die 26*a* for connecting with the ball of the holding means.

Figure 6:
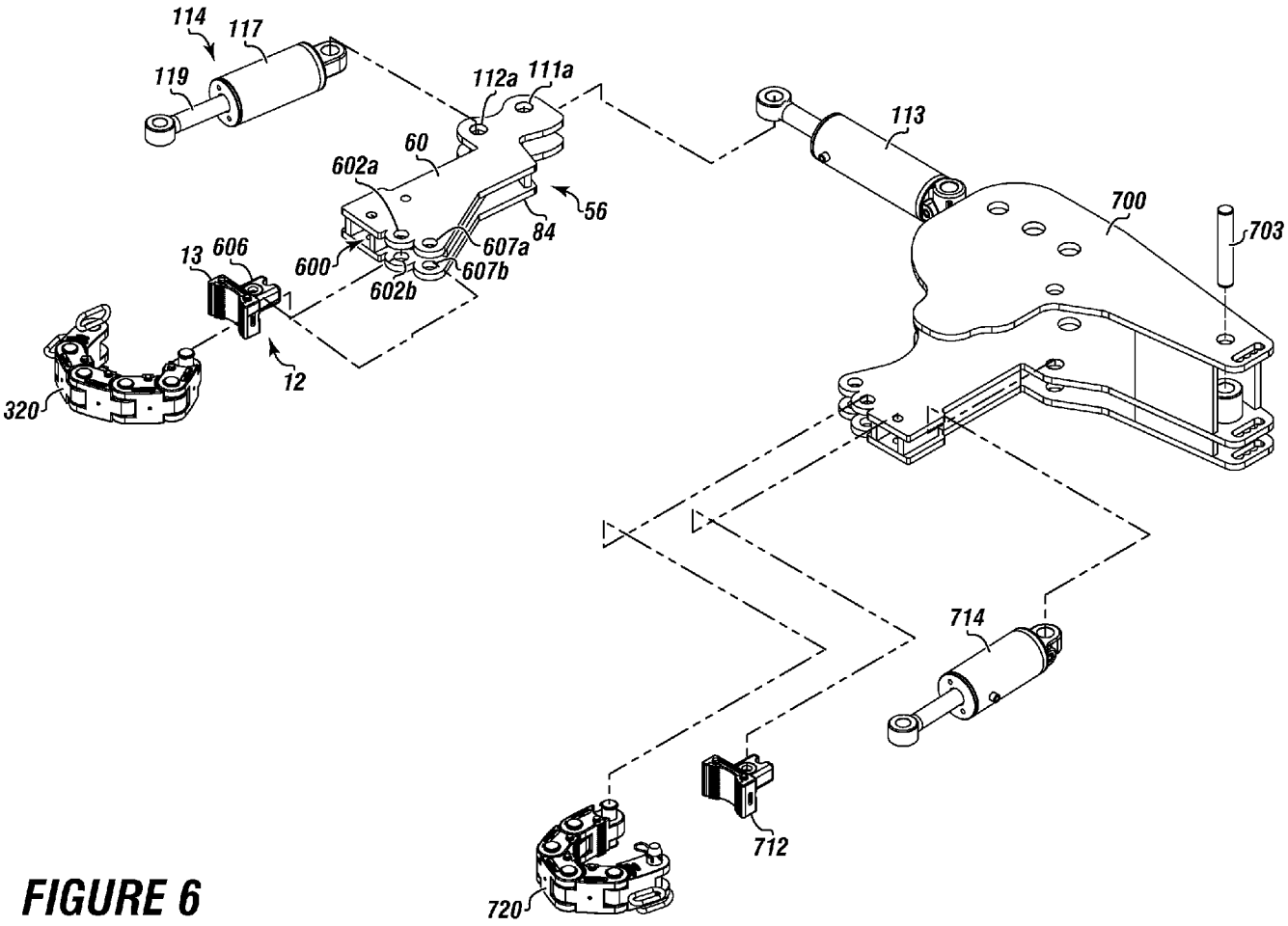
FIG. 6 is an exploded view of the tong assembly with two chain assemblies, two jaws, an arm frame, two chain cylinders, and one break-out/make-up cylinder and break-out/make-up body usable with one or more embodiments of the method.

FIG. 6 shows the arm frame with the top plate connected to the bottom plate usable with one or more embodiments of the method.

A pocket 600 for receiving the jaw tail 606 of the jaw 12 can be formed between the top plate 60 and the bottom plate 84. A chain assembly 320 can connect opposite the face of the jaw 12 forming a secure engagement for gripping tubulars. The jaw is shown with the jaw head 13.

The chain cylinder connection hole 112*a* can engage a chain connecting pin to engage a first chain cylinder 114.

The first chain cylinder 114 can have a cylinder body 117 and a rod 119.

The first top chain connection hole 602*a* and the first bottom chain connection hole 602*b* can engage a chain connecting pin to secure the chain assembly 320 to the arm frame 56.

The second top chain connection hole 607*a* and the second bottom chain connection hole 607*b* can engage a chain connecting pin to secure the chain assembly 320 to the first arm on an end opposite the first chain connecting pin.

A break-out/make-up cylinder 113 can be connected to the break-out/make-up cylinder connection hole 111*a* with a pin through the arm frame 56.

The jaw 12 can be fixedly secured between the top and bottom plates within the pocket 600 using the jaw retaining pin that engages the top fastening hole.

The break-out/make-up cylinder 113 can also engage a rigid body 700 using a break-out/make-up arm anchoring pin 703.

The rigid body 700 can engage a second chain cylinder 714 using a chain connecting pin.

A second chain cylinder 714 can connect to a second jaw 712 that can engage a second chain assembly 720 for holding the first tubular.

Figure 7:
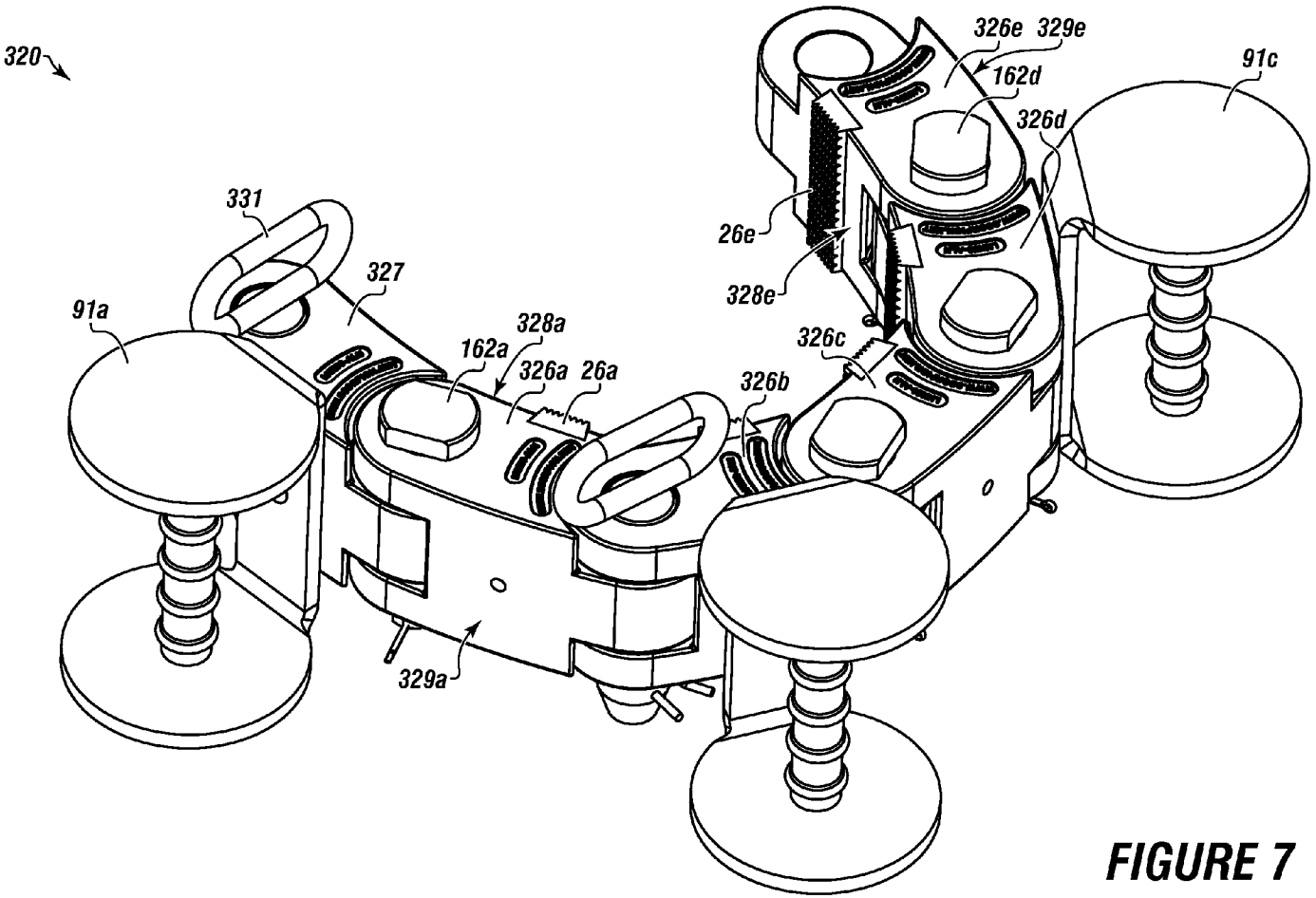
FIG. 7 is a detail of a chain assembly usable with one or more embodiments of the method.

FIG. 7 shows a chain assembly usable with one or more embodiments of the method.

The chain assembly 320 can have a plurality of chain links 326*a*-326*e*, which can be connected in series.

A locking link 327 can be connected using a locking pin 331 to engage one of the chain links with the chain cylinder.

Each chain link can have a chain link face 328*a*-328*e* and a chain link back 329*a*-329*e*.

At least one tong die groove can be formed in each chain link face.

Each tong die groove can have groove edges for slidably receiving a tong die which opposes tong dies in tong die grooves on the jaw. Tong dies 26*a*-26*e* are shown engaging the tong die grooves on the chain link faces of the chain links.

A plurality of handles 91*a*-91*c* can be connected to the chain assembly.

In embodiments, one of the handles can be attached to a connecting link, a chain link, or a locking link.

Each handle can have an upper handle plate with an upper flat edge, a lower handle plate with a lower flat edge; an attachment plate integral with the upper flat edge and integral with the lower flat edge and extending between the upper handle plate and the lower handle plate; and a gripping post affixed between the upper handle plate and the lower handle plate.

In embodiments, each of the chain links can be connected to hinge pins 162*a*-162*d* through the first top chain connection hole and the first bottom chain connection hole into the arm frame.

Figure 8:
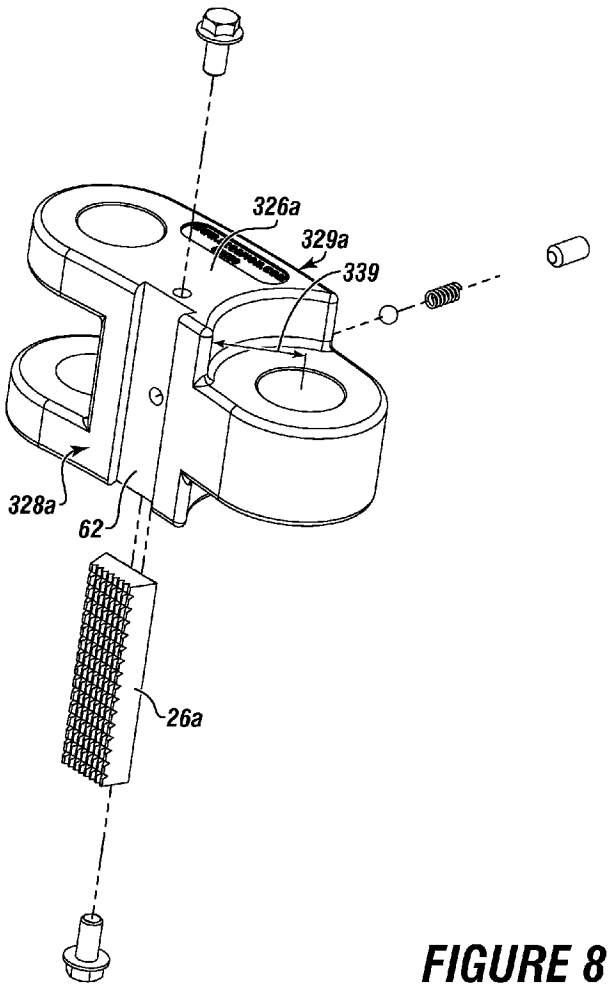
FIG. 8 is a detail of a chain link usable in a chain assembly usable with one or more embodiments of the method.

FIG. 8 depicts a detail of a chain link usable in the chain assembly usable with one or more embodiments of the method.

The chain link 326*a* is shown with a groove 62 for containing the tong die 26*a* on the chain link face 328*a* of the chain link. A chain link radius 339 is also shown.

The chain link is depicted with the chain link back 329*a*.

In embodiments, the face of the jaw can have three parallel tong die grooves and a tong die in one or more parallel tong die grooves.

The tong die grooves can have groove edges, which can incline towards a center line as the groove edges extend from the rocker jaw body, such as at a 75 degree angle.

The face can have a facial radius, which can be large enough to accommodate the tubular, such as a facial radius which can be from about 2 inches to about 60 inches.

The tong die can include one or more tooth beds. The tooth beds can support a plurality of teeth, which can extend from the tooth bed.

In embodiments, tong dies usable with the apparatus can have teeth. In other embodiments, tong dies without teeth can be used. The tong die usable in embodiments can be any tong die that is available for use in the make-up or break-out of tubulars.

The plurality of teeth can be used for gripping the tubular and can be of various shapes and spacing, such as pyramid shaped teeth spaced equidistant from one another with 8 rows and 16 columns of teeth total.

The tong die can include tooth bed edges. The tooth bed edges can have a slope, such as a slope of about 75 degrees. The slope of the tooth bed edges can provide a flush fit with the groove edges.

While these embodiments have been described with emphasis on the embodiments, it should be understood that within the scope of the appended claims, the embodiments might be practiced other than as specifically described herein.

What is claimed is:

1. A method to break-out/make-up a pair of tubulars using a tong assembly for use in drilling a wellbore, comprising:

a. engaging a first tubular with a chain assembly connected to a rigid body;

b. pulling the chain assembly tight around the first tubular using a chain cylinder connected to the rigid body to:

(i) connect the first tubular with a jaw secured to the rigid body; and (ii) connect tong dies on the chain assembly to the first tubular;

wherein the rigid body is a fixed back up for the breaking-out and making-up of the first tubular with a second tubular;

c. engaging a second tubular with a second chain assembly connected to a break-out frame;

d. pulling the second chain assembly tight around the second tubular using a second chain cylinder to:

(i) connect the second tubular with a second jaw secured to the break-out frame; and (ii) connect tong dies on the second chain assembly with the second tubular; and e. operating a break-out/make-up cylinder connected to the rigid body to:

(i) perform a make-up operation by rotating the chain assembly in a first direction rotating the first tubular while holding the second tubular with the second chain assembly without movement of the second chain assembly creating a backup assembly, enabling the two tubulars to connect together and form a tubing joint; and (ii) perform a break-out operation by rotating the chain assembly in a second direction opposite the first direction rotating the first tubular while holding the second tubular with second chain assembly without movement of the second chain assembly creating a backup assembly, enabling the two tubulars to separate and be broken out.

2. The method of claim 1, comprising the step of using tubulars with an outer diameter from 1 inch to 36 inches.

3. The method of claim 1, performing the step of pulling either of the chain assemblies tight around the tubulars using pressure from 100 psi to 4000 psi.

4. The method of claim 1, further comprising rotating of the chain assembly occurs from 0 degrees to 90 degrees.

5. The method of claim 4, further comprising rotating of the chain assembly occurs from 0 degrees to 45 degrees for make-up of the tubulars and 0 degrees to 45 degrees for break-out of the tubulars.

6. The method of claim 1, further comprising an arm frame, wherein the arm frame comprises:

a. a top plate comprising:

(i) a top fastening hole for receiving a jaw retaining pin;

(ii) a top reducer hole;

(iii) a first top chain connection hole;

(iv) a second top chain connection hole;

(v) a break-out/make-up cylinder connection hole to engage a cylinder connecting pin for holding the break-out/make-up cylinder;

(vi) a chain cylinder connection hole to engage a cylinder connecting pin for holding the chain cylinder;

(vii) a first concave edge configured to accommodate a chain link of the first chain assembly, wherein the chain link connects to the arm frame, and the chain link has a link radius;

(viii) a second concave edge configured to accommodate a plurality of chain links, wherein the plurality of chain links have a chain link radius larger than the link radius;

(ix) a notch formed in the top plate, the notch configured to accommodate a body of the chain cylinder; and (x) a jaw resting edge formed in the top plate, the jaw resting edge configured to support the jaw;

b. a bottom plate comprising:

(i) a bottom fastening hole;

(ii) a bottom reducer hole;

(iii) a first bottom chain connection holes;

(iv) a second bottom chain connection hole;

(v) a break-out/make-up cylinder connection hole to engage a cylinder connecting pin for holding the break-out/make-up cylinder;

(vi) a chain cylinder connection hole to engage a cylinder connecting pin for holding the chain cylinder;

(vii) a first concave edge configured to accommodate a chain link of a first chain assembly, wherein the chain link connects to the arm frame, and the chain link has a link radius;

(viii) a second concave edge configured to accommodate a larger chain link, wherein the plurality of chain links have a chain link radius larger than the link radius;

(ix) a notch formed in the bottom plate configured to accommodate a body of the chain cylinder; and (x) a jaw resting edge formed in the bottom plate, the jaw resting edge configured to support the jaw;

c. a pair of load support walls forming a pocket for holding a jaw tail of the jaw between the top plate and the bottom plate; and d. at least one spacing bar disposed between the top plate and the bottom plate.

7. The method of claim 6, wherein the chain assembly is connected to the arm frame using a pair of chain assembly pins, one chain assembly pin connecting each end of the chain assembly, each chain assembly pin penetrating aligned chain connection holes in the top plate and the bottom plate.

8. The method of claim 6, wherein the jaw comprises a jaw head and the jaw tail, wherein the jaw head has a face and at least one tong die groove adjacent the face and a load surface opposite the face, the jaw tail fixedly secured between the top and bottom plates of the arm frame within a pocket using a jaw retaining pin inserted through a tail hole in the jaw tail and through the top fastening hole and the bottom fastening holes simultaneously, and a tong die held into each tong die groove with a holding means.

9. The method of claim 8, using on the face of each jaw and each chain assembly a plurality of parallel tong die grooves with a tong die in each tong die groove.

10. The method of claim 8, wherein the holding means is a detent or a fastener.

11. The method of claim 8, using a tapered tail opposite the jaw head while maintaining at least 50 percent continuous contact between the outer surface and the load supporting walls and between the top plate and the bottom plate for load transfer from the jaw tail to the arm frame or the rigid body.

12. The method of claim 8, further comprising forming a tapered jaw tail with an axis for engagement with the jaw head, wherein ends of the tapered jaw tail extend from the jaw head and come together toward the axis.

13. The method of claim 6, comprising using a latching member extending from a load surface of the jaw to engage the jaw resting edges of the top plate and the bottom plate of the arm frame for preventing lateral motion of the jaw.

14. The method of claim 6, using each chain assembly to enable flexibility to connect around variable outer diameters of the tubulars, wherein the plurality of chain links connect in series, a locking link connecting one of the chain links to the chain cylinder, and wherein the chain links connect in series and connect around a tubular outer diameter; and wherein each chain link comprises:

a. a chain link face;

b. a chain link back;

c. at least one tong die groove formed in each chain link face having groove edges; and d. a tong die slidable into one of the tong die grooves.

15. The method of claim 14, further comprising using a plurality of handles, wherein one of the handles is attached to a chain link, or the locking link providing gripping safety when installing the chain assembly around the tubular or removing the chain assembly from the tubular.

16. The method of claim 6, connecting each of the chain links in series to hinge pins through connection holes into the arm frame for quick connect and quick disconnect in the case of an emergency.

17. The method of claim 6, further comprising a plurality of side support plate connected between the top plate and the bottom plate.

18. The method of claim 1, installing dampers around a tail hole formed in the jaw to align the jaw and to reduce vibration using:

a. a first damper into a first damper cavity surrounding a first side of the tail hole; and b. a second damper in a second damper cavity surrounding a second side of the tail hole.

* * * * *